US005601070A

United States Patent [19]

Hotard et al.

[11] Patent Number: 5,601,070

[45] Date of Patent: Feb. 11, 1997

[54] CONVECTION OVEN

[75] Inventors: Thomas C. Hotard, Fuquay-Varina; Robert D. Morrison, Cary, both of N.C.

[73] Assignee: Middleby Marshall, Inc., Elgin, Ill.

[21] Appl. No.: 664,699

[22] Filed: Jun. 17, 1996

[51] Int. Cl.[6] ..... F24C 15/32

[52] U.S. Cl. ..... 126/21 A; 126/273 R; 219/400; 432/176; 432/199; 415/208.3

[58] Field of Search ..... 126/21 A, 19 R, 126/21 R, 273 R, 275; 432/176, 199, 152; 219/400; 99/473, 477, 446, 443 R, 449, 450; 415/208.3

[56] References Cited

U.S. PATENT DOCUMENTS

| | | | |
|---|---|---|---|
| 3,324,844 | 6/1967 | Huffman | 219/400 |
| 4,094,631 | 6/1978 | Grieve | 126/21 A |
| 4,357,522 | 11/1982 | Husslein et al. | 126/21 A |
| 4,780,596 | 10/1988 | Matsushima | 219/400 |
| 4,813,398 | 3/1989 | Savage | 126/21 A |
| 4,870,254 | 9/1989 | Arabori et al. | 219/400 |
| 4,928,663 | 5/1990 | Nevin et al. | 126/21 A |
| 5,222,474 | 6/1993 | Yencha, III | 126/21 A |

FOREIGN PATENT DOCUMENTS

| | | | |
|---|---|---|---|
| 006326 | 1/1988 | Japan | 126/21 A |
| 70030 | 3/1988 | Japan | 126/21 A |

*Primary Examiner*—James C. Yeung
*Attorney, Agent, or Firm*—Rhodes, Coats & Bennett, L.L.P.

[57] ABSTRACT

A convection oven having an insulated oven chamber bounded by a front access door, a floor, a ceiling, two side walls, and a rear wall. An inlet air passageway, which includes a heating element, delivers heated air to the oven chamber, and an exhaust passageway exhausts air from the oven chamber. A baffle plate spaced from the rear wall divides the oven chamber into a blower compartment and a baking compartment, which are connected by a return air opening in the baffle plate and at least one peripheral opening outwards of the return air opening. A blower fan in the blower compartment draws heated air into the oven chamber, mixes the heated air with air already inside the even chamber, circulates the mixed air throughout the oven chamber, and expels air through the exhaust passageway. To alleviate problems caused by high and low pressure zones created in diagonally opposing corners of the blower compartment by rotation of the blower fan, two pairs of diverter plates are disposed around the blower fan. These diverter plates are configured so as to reduce the air pressure in the otherwise high pressure corners and to increase the air pressure in the otherwise low pressure corners. Additionally, the diverter plates create negative pressure to draw air from the combustion chamber into the oven chamber. Each pair of diverter plates is disposed along separate diametrical axes that are perpendicular to each other. In addition, one pair of diverter plates is disposed closer to the blower fan than the other. The diverter plates cooperate with one another in such as way as to mimic air pumps that divert air away from the high-pressure corners and into the low-pressure corners. Thus, the diverter plates tend to equalize the air pressure among the corners of the blower compartment. This helps equalize the air pressure throughout the oven chamber, which in turn ensures even cooking of food.

32 Claims, 6 Drawing Sheets

CONVECTION OVEN

FIELD OF THE INVENTION

This invention generally relates to convection ovens and more particularly relates to air distribution systems for a convection oven.

BACKGROUND OF THE INVENTION

Convection ovens have enjoyed wide-spread popularity in commercial food establishments due to their ability to quickly and efficiently cook large quantities of food. Both electric and gas-fired convection ovens are known. Gas-fired convection ovens typically include an insulated oven chamber having an access door on the front side thereof. An inlet air passageway including a combustion chamber is typically located below the oven chamber and is separated from the oven chamber by the floor. One or more gas burners fire into the combustion chamber and heat the air within. A blower fan is disposed in the oven chamber, typically in the rear, and draws heated air from the combustion chamber into the oven chamber. The blower fan then mixes the heated air with air already in the oven chamber and circulates the mixed air within the oven chamber to cook food therein. An exhaust passageway, typically in the upper part of the oven, exhausts air that is displaced by the heated air from the combustion chamber.

One problem that has been experienced in the past with convection ovens is uneven temperature throughout the oven which results in uneven cooking. One cause of non-uniform temperatures is the creation of high and low pressure zones in the oven chamber. When a typical blower fan of a convection oven rotates, it creates high and low pressure zones in diagonally opposing corners of the oven chamber. For example, when the blower wheel rotates in a clockwise direction, as viewed from the front of the oven, high pressure zones are created in the upper left and lower right regions of the oven chamber. Conversely, low pressure zones are created in the upper right and lower left regions of the oven chamber. These different pressure zones lead to non-uniform air temperatures in the oven, which in turn lead to non-uniform cooking.

Therefore, a need exists for an improved air distribution system in a convection oven that minimizes high and low pressure zones, thereby creating more uniform temperatures throughout the oven to ensure more even cooking of food therein.

SUMMARY OF THE INVENTION

The present invention is directed to a convection oven having an insulated oven chamber bounded by a front access door, a floor, a ceiling, two side walls, and a rear wall. An inlet air passageway disposed below the floor of the oven chamber communicates at one end with ambient external air and at another end with a vertical flue chamber extending upward behind the oven chamber. A conventional heating element, which is preferably a gas burner, is provided to heat air in the inlet air passageway before the air is introduced into the oven chamber. An exhaust passageway also communicates with the oven chamber to exhaust air which is displaced by the incoming air from the air inlet passageway. A blower fan, which is preferably mounted against the rear wall, draws heated air from the inlet air passageway into the oven chamber, mixes the heated air with air already inside the oven chamber, circulates the mixed air throughout the oven chamber, and expels air from the oven chamber through the exhaust passageway.

An air distribution system in the oven chamber regulates the circulation and distribution of air therein. As in conventional convection ovens, the air distribution system includes a baffle plate spaced outwardly from the wall of the oven chamber which divides the oven chamber into a baking compartment where food is cooked, and a blower compartment where the blower fan is located. A return air opening in the baffle plate provides a path for air in the baking compartment to be drawn into the blower compartment for mixing with the heated air drawn in from the inlet air passageway. In addition, at least one peripheral opening radially outward of the return air opening connects the blower compartment with the baking compartment to permit air to flow from the blower compartment into the baking compartment.

As with other convection ovens of this type, rotation of the blower fan tends to create high pressure zones in two diagonally opposing corners of the blower compartment and low pressure zones in two other diagonally opposing corners of the blower compartment. To avoid this problem, the present invention includes two pairs of diverter plates in the blower compartment which essentially form a compartment surrounding the blower fan. These two pairs of diverter plates are precisely configured and arranged so as to reduce the air pressure in the otherwise high pressure corners of the blower compartment and increase the air pressure in the otherwise low pressure corners of the blower compartment. A first pair of diverter plates are disposed in the blower compartment on diametrically opposite sides of the blower fan, each of the first pair of diverter plates being disposed adjacent to one of the low pressure zones. A second pair of diverter plates are disposed in the blower compartment on diametrically opposite sides of the blower fan, each of the second pair of diverter plates being disposed adjacent to one of the high pressure zones. The first pair of diverter plates is preferably disposed closer to the rotational axis of the blower fan than the second pair of diverter plates. This arrangement provides a more uniform distribution of pressure thereby resulting in more even cooking of food within the baking compartment.

Other aspects and advantages of the present invention will become apparent and obvious from a study of the following description and the accompanying drawings, which are merely illustrative of the invention.

DETAILED DESCRIPTION OF THE INVENTION

Figure 1:
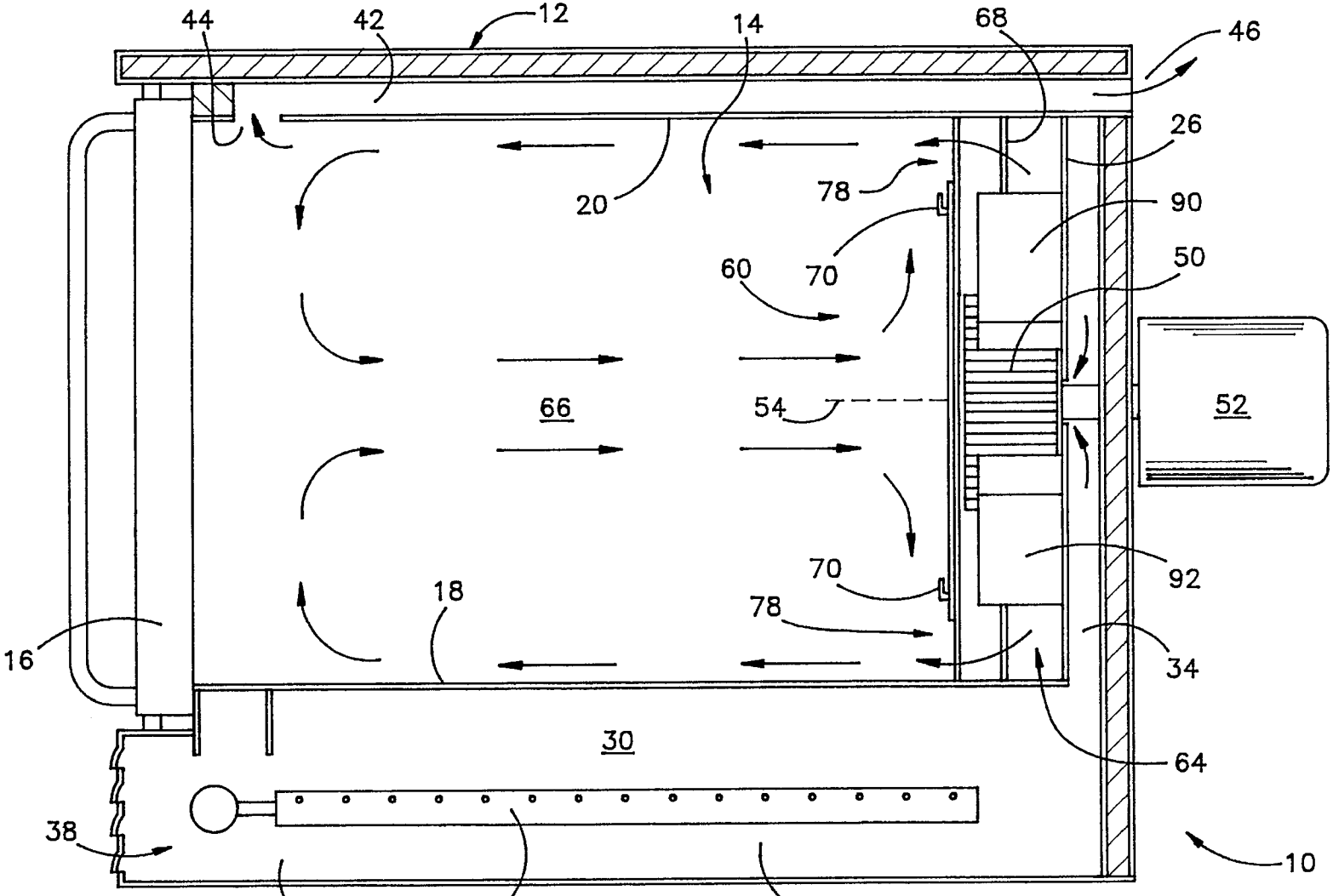
FIG. 1 is a cross-sectional view of a preferred embodiment of the convection oven of the present invention.

The present invention is described more fully hereinafter by referring to the drawings, in which a preferred embodiment is depicted. However, the present invention can take on many different embodiments and is not intended to be limited to the embodiments described herein.

Referring now to the drawings in general and FIG. 1 in particular, a convection oven, generally designated 10, is shown constructed according to the present invention. The convection oven 10 includes an insulated housing 12 that encompasses an internal oven chamber 14 bounded by a front access door 16, a floor 18, a ceiling 20, two side walls 22 and 24, and a rear wall 26. The oven housing 12 may have any suitable form, shape, and size and includes conventional thermostats, timers, and other controlling devices.

To supply air to the oven chamber 14, an inlet air passageway 30 is disposed within the housing 12 below the floor 18 of the oven chamber 14. The inlet air passageway 30 extends from the front to the back of the oven 10. The front end is open and communicates with ambient external air. The rear end communicates with a vertical flue chamber 34, disposed behind the oven chamber 14.

One or more heating elements heat the air in the inlet air passageway 30 before the air is introduced into the oven chamber 14. Any conventional heating element may be used. For example, an electrical resistance heating element may be disposed in the inlet air passageway 30 to heat air therein. However, in the preferred embodiment, the heating element comprises a tube-type gas burner 40. Thus, the air passageway 30 functions as a combustion chamber 36.

To exhaust air from the oven chamber 14, an exhaust passageway 42 communicates with the oven chamber 14 at an entrance 44 and with ambient air at an exit 46. Preferably, the exhaust passageway 42 is disposed within the housing 12 above the ceiling 20 of the oven chamber 14 with the entrance 44 near the front of the oven chamber 14. Hence, the entrance 44 is preferably disposed in the ceiling 20. In the alternative, however, the entrance 44 to the exhaust passageway 42 could be disposed in one of the side walls 22, 24 or in the rear wall 26.

Figure 4:
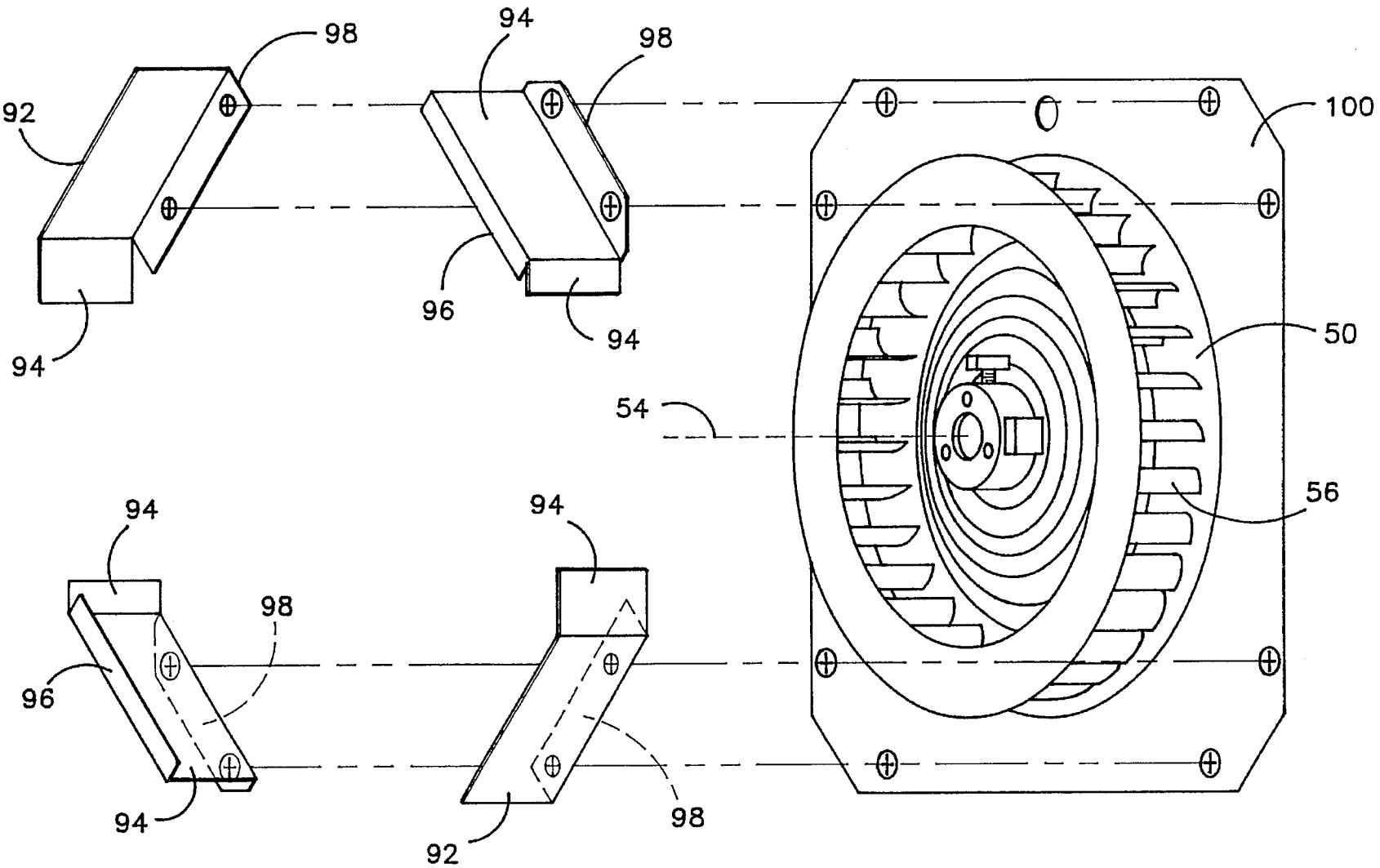
FIG. 4 is an exploded perspective view of the blower fan and diverter plates.

As shown best in FIGS. 1 and 4, a blower fan 50 is mounted against one of the walls of the oven chamber 14 for drawing heated air from the inlet air passageway 30 into the oven chamber 14, circulating the heated air in the oven chamber 14 to cook food therein, and expelling air through the exhaust passageway 42. While the blower fan 50 may be mounted against one of the side walls 22 or 24 of the oven chamber 14, it is preferably mounted against the rear wall 26. The blower fan 50 is rotated by a motor 52, which is preferably located so as to be isolated from heat emanating from the oven chamber 14. The blower fan 50 is preferably wheel-shaped, having one or more rows of blades 56 around its periphery. As the blower fan 50 rotates, air is drawn into its center from both its front and back sides then flung outwardly by the blades 56.

An air distribution system 60 is provided to regulate the circulation and distribution of air in the oven chamber 14. The air distribution system 60 includes a baffle plate 62 spaced outwardly from the rear wall 26. If the blower fan 50 is mounted against a side wall, the baffle plate 62 would, in that case, be spaced from the side wall. The baffle plate 62 divides the oven chamber 14 into a blower compartment 64 containing the blower fan 50 and a baking compartment 66 in which food is cooked.

Any conventional means may be provided to support the baffle plate 62. However, in the preferred embodiment of the oven 10 of the present invention, two support channels 68 are mounted to respective side walls 22, 24. Each baffle support channel 68 includes hooks 70 that fit through corresponding slots 72 in the baffle plate 62. The baffle plate 62 hangs on the hooks 70 and can be easily removed for cleaning the baffle plate and the rear portion of the oven chamber 14. The hooks 70 extend forwardly from the side channel 68 and include a v-shaped notch 71 in which the baffle plate 62 rests. The hooks 70 support the baffle plate 62 in spaced relation to the side channels 68.

Figure 2:
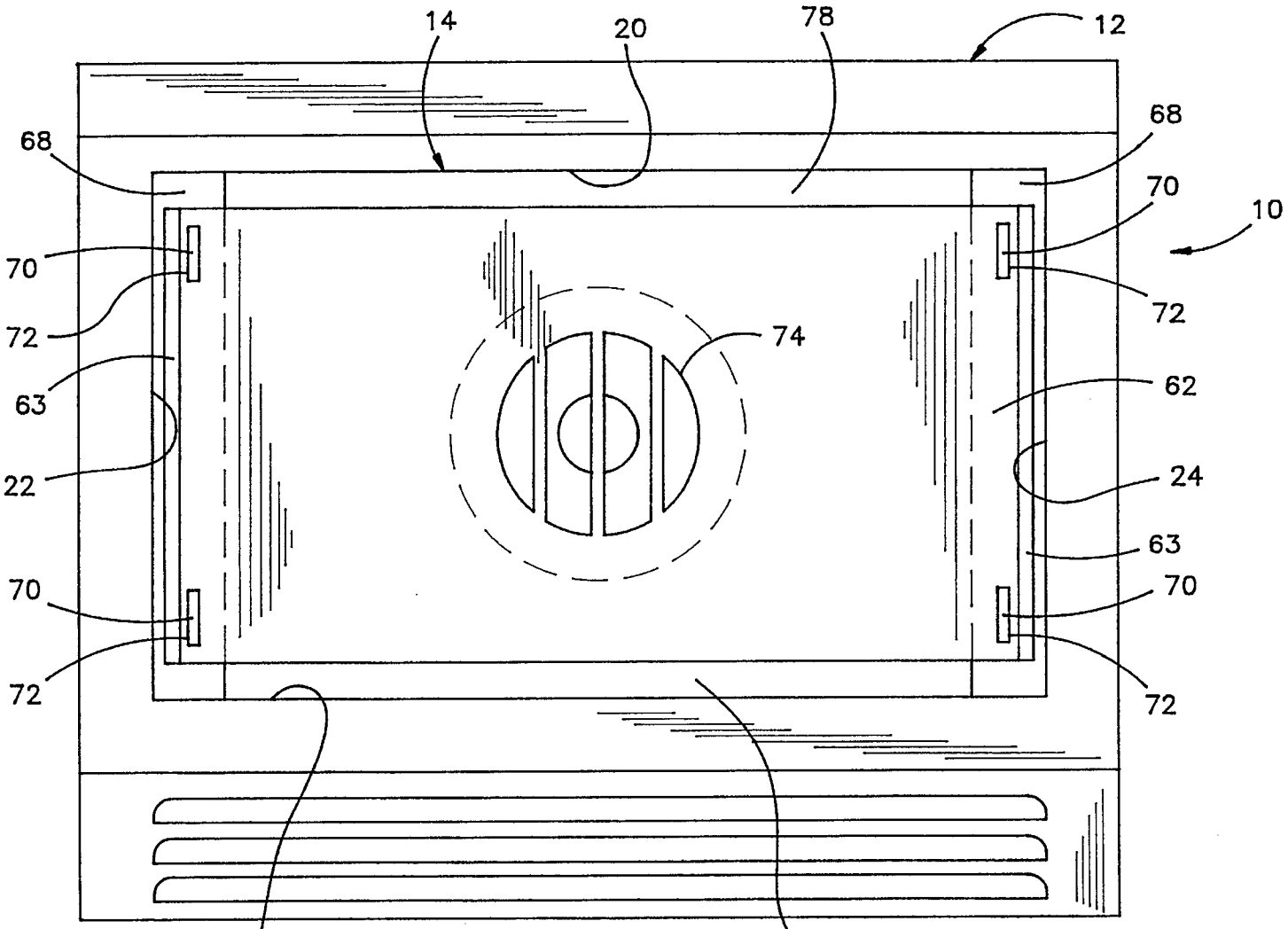
FIG. 2 is a front elevational view of the interior of the oven chamber, seen here with the baffle plate in place to separate the blower compartment from the baking compartment.

As clearly shown in FIG. 2, peripheral openings 78 are defined between the four edges of the baffle 62 and the interior walls of the oven chamber 14. One peripheral opening 78 is formed between the top edge of the baffle plate 62 and the top of the oven chamber 14. A second peripheral opening 78 is formed between the bottom edge of the baffle plate 62 and the bottom 18 of the oven chamber 14. Third and fourth peripheral openings are formed between the side edges 63 of the baffle plate 62 and respective sidewalls 22 and 24 of the oven chamber 14. As previously mentioned, the hooks 70 support the baffle plate 62 in spaced relation to the side channel 68. By supporting the baffle plate 62 in this manner, air is allowed to freely flow around the side edges 63 of the baffle plate 62. The side edges 63 are preferably bent forwardly to facilitate the airflow around the side edges 63.

While the peripheral openings 78 have been described as air spaces between the edges of the baffle and the interior surfaces of the baking cavity 14, it should be understood that the peripheral openings 78 may also constitute one or more holes defined in the baffle plate 62 itself.

The baffle plate 62 defines pathways for air circulating between the blower compartment 64 and the baking compartment 66. As shown in FIG. 2, a return air opening 74 is formed in the center of the baffle plate 62 directly in front of the blower fan 50 to provide a path for air to flow from the baking compartment 66 to the blower compartment 64. The blower 50 mixes the return air with combustion product from the combustion chamber 30 and slings the air radially outward in all directions. The mixed air flows around all four sides of the baffle from the blower compartment 64 back into the baking compartment 66.

During operation of the convection oven 10, the blower fan 50 rotates and draws air from the baking compartment 66 through the return air opening 74. Combustion products are also drawn by the blower fan 50 from the flue chamber 34 into the blower compartment 64. The combustion products enter the blower compartment 64 via an oversized opening surrounding the shaft of the blower fan motor 52. The blower fan 50 mixes the combustion products with the air from the baking compartment 66 and then expels this mixed air from the blower compartment 64 into the baking compartment 66 through the peripheral openings 78. Exhaust air that is displaced by the incoming heated air is expelled through the exhaust passageway 42.

The baffle plate 62, the return air opening 74, and the peripheral openings 78 generally create the air circulation pattern within the oven chamber 14 shown in FIG. 1. However, as those familiar with convection ovens are aware, rotation of the blower fan 50 tends to create high pressure zones in two diagonally opposing corners of the blower compartment 64 and low pressure zones in the other two diagonally opposing corners of the blower compartment 64. In particular, with a clockwise-rotating blower fan 50, as viewed from the front, low pressure zones tend to form in the lower left corner and upper right corner. Conversely, high pressure zones tend to form in the upper left corner 84 and lower right corner. These high and low pressure zones in the corners of the blower compartment 64 lead to non-uniform air pressure and temperature in the baking compartment 66, which in turn leads to non-uniform cooking of food therein.

To alleviate this problem, the present invention utilizes two sets of diverter plates 90, 92 to equalize the air pressure throughout the oven chamber 14, including the baking compartment 66. These two pairs of diverter plates 90, 92 are precisely configured and arranged so as to reduce the air pressure in the otherwise high pressure corners of the blower compartment 64 and increase the air pressure in the otherwise low pressure corners of the blower compartment 64. By equalizing the pressure in the corners of the blower compartment 64, the diverter plates 90, 92 ensure that air is expelled through the peripheral length of the openings 78 at a substantially uniform pressure throughout the length of the openings 78. This in turn leads to more uniform air pressure and temperature within the baking compartment 66.

The diverter plates 90, 92 also function to draw air into the blower compartment from the combustion chamber. The diverter plates 90, 92 create a negative pressure behind the blower fan 50 that draws heated air into the blower compartment 64.

Figure 3:
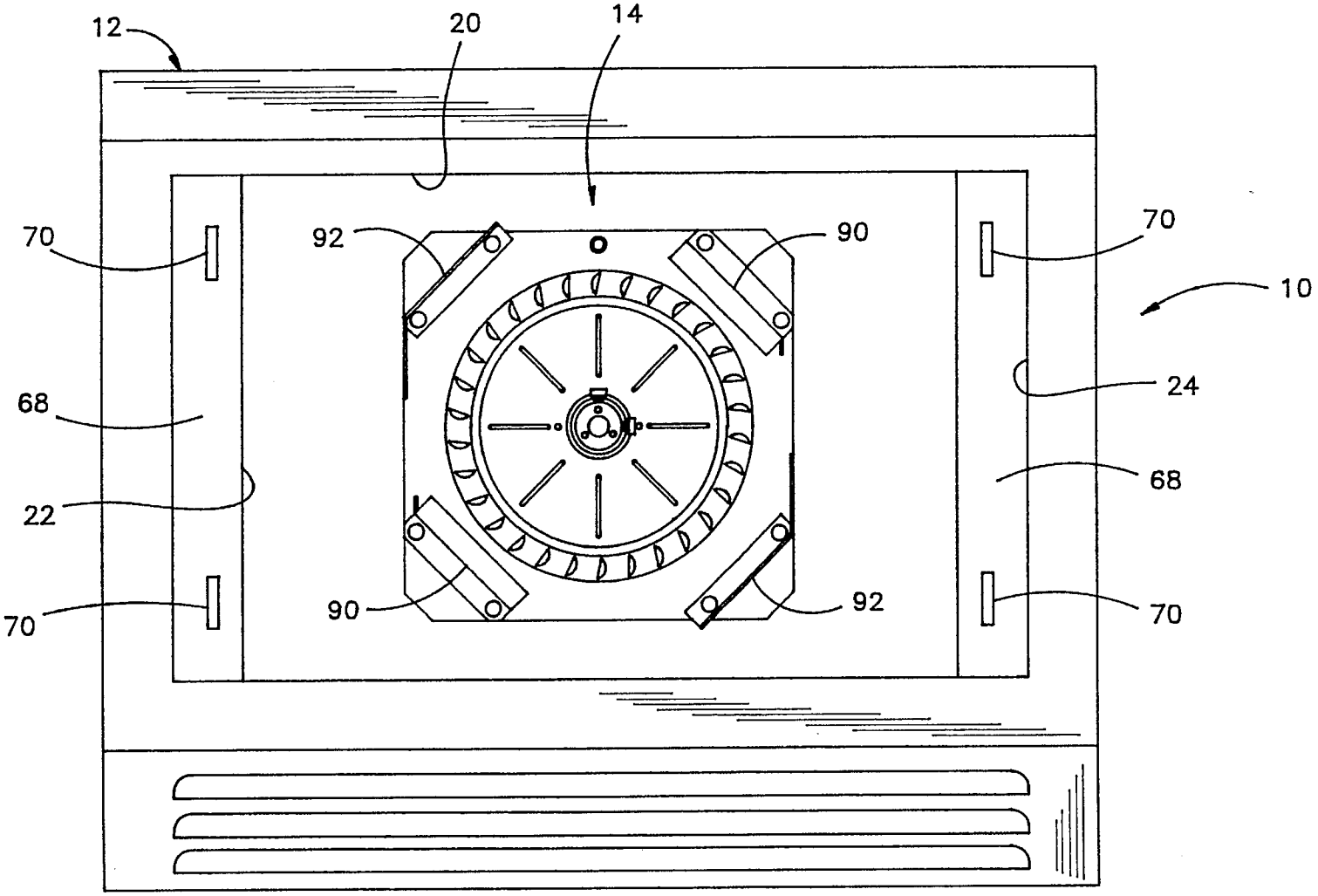
FIG. 3 is a front elevational view of the interior of the oven chamber, seen here with the baffle plate removed to reveal the diametrically opposed diverter plates around the blower fan.
Figure 5:
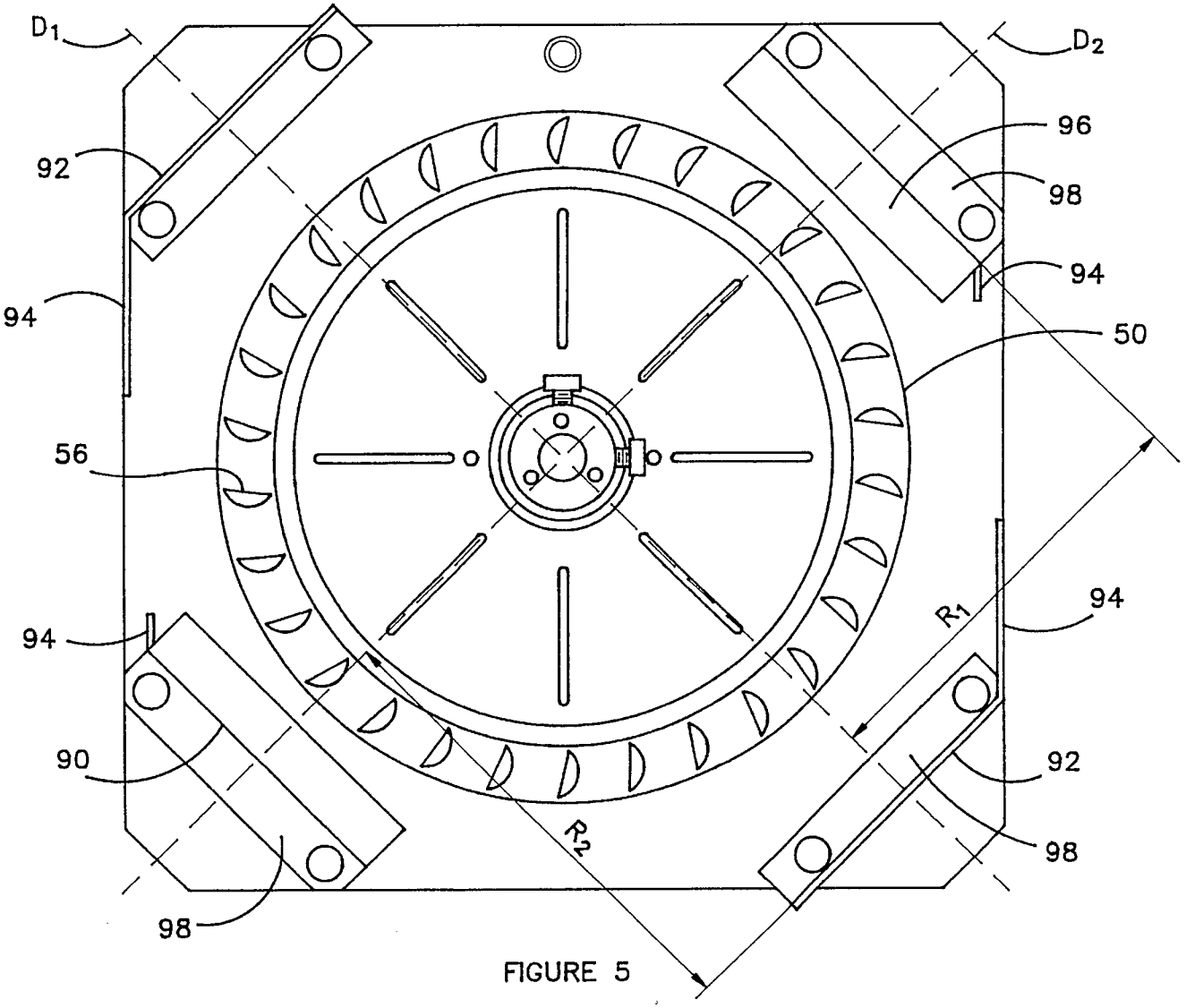
FIG. 5 is an enlarged elevational view of the blower fan and diverter plates that shows the preferred geometrical disposition of the diverter plates relative to the blower fan.
Figure 6:
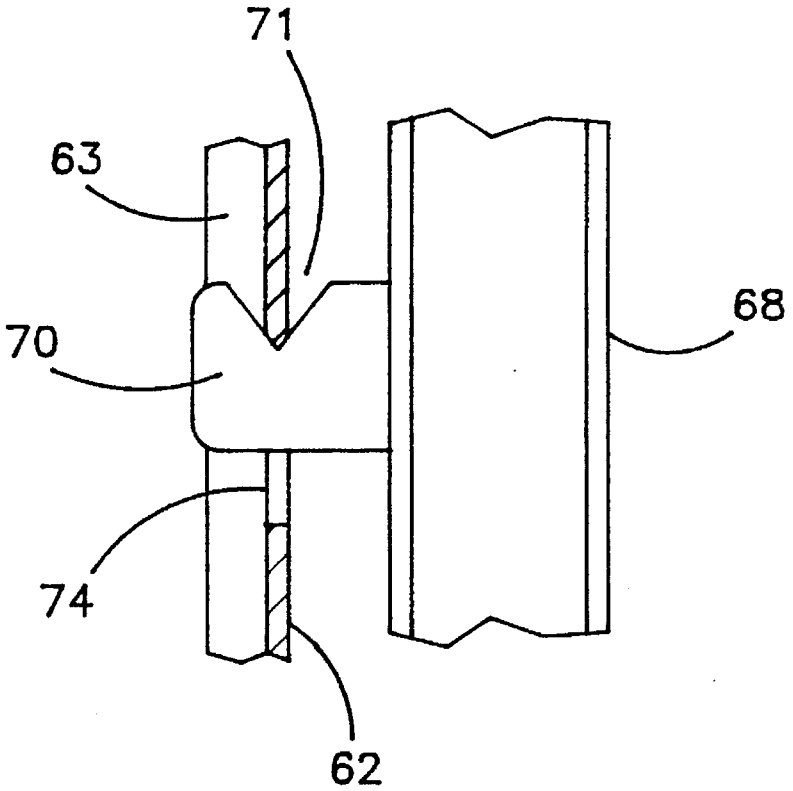
FIG. 6 is a detail view showing the hook supporting the baffle plate.

Shown best in FIGS. 3, 4, and 5, diverter plates 90 are disposed between the blower fan 50 and the low pressure zones, while diverter plates 92 are disposed between the blower fan 50 and the high pressure zones. In particular, diverter plates 90 are disposed adjacent to the lower left corner 80 and upper right corner 82. Diverter plates 92 are disposed adjacent to the upper left corner 84 and lower right corner 86. The first pair of diverter plates 90 are disposed on diametrically opposite sides of the blower fan 50 along a first diametrical axis D1. Similarly, the second pair of diverter plates 92 are disposed on diametrically opposite sides of the blower fan 50 along a second diametrical axis $D_2$. Preferably, both diametrical axes $D_1$ and $D_2$ intersect the rotational axis 54 of the blower fan 50. The first and second diametrical axes $D_1$ and $D_2$ are perpendicular to one another. The diverter plates 90 are disposed closer to the center rotational axis 54 of the blower fan 50 than the diverter plates 92. These radial distances from the rotational axis 54 of the blower fan 50 are indicated in FIG. 5 by the lines $R_1$ and $R_2$.

The diverter plates 90, 92 are preferably formed from heat-resistant sheet material such as 18 gauge stainless steel. In addition, the diverter plates 90, 92 are formed from solid sheet metal so that air cannot pass through the diverter plates 90, 92 themselves. However, in an alternate embodiment, the diverter plates could be perforated with holes or slots (not shown).

As depicted best in FIGS. 4 and 5, each of the diverter plates 90, 92, extend generally perpendicular to the rear wall 26 of the oven chamber 14 and the baffle plate 62. The diverter plates 90, 92 are preferably planar although they could also be curved.

Each of the diverter plates 90, 92 includes a lateral flange 94 attached to a side edge thereof. The lateral flange 94 is attached to the trailing edge of diverter plates 90 and the leading edge of diverter plates 92. The lateral flanges 94 are preferably the same height as the diverter plates 90, 92 and extend at approximately a 45 degree angle from the respective diverter plates 90, 92. However, the lateral flanges 94 of the diverter plates 92 are preferably longer than the lateral flanges 94 of the diverter plates 90.

In addition to the lateral flange 94, each diverter plate 90 also includes a horizontal flange 96 attached to a top edge thereof and extending therefrom towards the blower fan 50. Preferably, neither one of the second pair of diverter plates 92 includes a horizontal flange. In the diverter plates 90, the horizontal flanges 96 are preferably disposed perpendicular to the respective diverter plate 90 and are thereby disposed generally parallel to the rear wall 26 of the oven chamber 14.

The diverter plates may be mounted in the blower compartment 64 in any of several ways. Preferably, each diverter plate 90, 92 includes a respective mounting flange 98 that is secured to the rear wall 26 of the oven chamber 14. As shown, the mounting flanges 98 are attached to respective bottom edges of the diverter plates 90, 92. The mounting flanges 98 may be secured directly to the rear wall 26 by fasteners such as bolts, rivets, screws, etc. In the alternative, the mounting flanges 98 may be first secured to a mounting plate 100, which is in turn secured to the rear wall 26. In yet another embodiment (not shown), the diverter plates 90, 92 may be secured to a rear surface of the baffle plate 62. In this embodiment wherein the diverter plates 90, 92 are secured to the baffle plate 62, each diverter plate 90, 92 is a mirror image of that described herein so that air will be channeled in the same manner as by the diverter plates of the preferred embodiment.

During operation of the convection oven 10 of the present invention, the diverter plates 90, 92 define a box surrounding the blower fan 50 which for example, functions similarly to an air pump. Air flowing around the blower fan 50 decreases in velocity and increases in pressure as it passes from the inside of the diverter plate 90 to the inside of the diverter plate 92. This helps equalize the air pressure throughout the oven chamber 14, which in turn ensures even cooking of food.

The present invention may, of course, be carried out in other specific ways than those herein set forth without departing from the spirit and essential characteristics of the invention. For example, the particular dimensions used in describing the prototype of the convection oven built according to the present invention are not intended to limit the scope of the claims, but are provided only as examples. The present embodiments are, therefore, to be considered in all respects as illustrative and not restrictive, and all changes coming within the meaning and equivalency range of the appended claims are intended to be embraced therein.

What is claimed is:

1. A convection oven, comprising:

a) an insulated oven chamber having a floor, a ceiling, a plurality of walls, and an access door;

b) an inlet air passageway communicating at one end with ambient external air and at another end with said oven chamber;

c) a heating element for heating air in said inlet air passageway;

d) an exhaust passageway communicating with said oven chamber for exhausting air therefrom;

e) a baffle plate spaced from one of said walls, said baffle plate dividing said oven chamber into a baking compartment in which food is cooked and a blower compartment;

f) a blower fan disposed in said blower compartment for drawing heated air from said inlet air passageway into said oven chamber, circulating the heated air in said oven chamber, and expelling air through said exhaust passageway, whereby rotation of said blower fan tends to create high pressure zones in two diagonally opposing corners of said blower compartment and low pressure zones in two other diagonally opposing corners of said blower compartment;

g) a first pair of diverter plates disposed in said blower compartment on diametrically opposite sides of said blower fan; and h) a second pair of diverter plates disposed in said blower compartment on diametrically opposite sides of said blower fan;

i) wherein said two sets of diverter plates are arranged so as to reduce air pressure in said high pressure zones and increase air pressure in said low pressure zones, thereby tending to equalize air pressure within said oven chamber and ensure uniform cooking of food therein.

2. The convection oven according to claim 1, wherein said access door is located at a front of said oven chamber and said blower fan is mounted against a rear wall of said oven chamber opposite said access door.

3. The convection oven according to claim 1, wherein at least a portion of said inlet air passageway is disposed under the floor of the oven chamber, and wherein said inlet air passageway includes a front end open to ambient external air.

4. The convection oven according to claim 1, wherein said inlet air passageway includes a combustion chamber, and wherein said heating element comprises a gas burner for heating air in said combustion chamber.

5. The convection oven according to claim 4, wherein said gas burner comprises a burner mounted adjacent to an open entrance of said combustion chamber.

6. The convection oven according to claim 1, wherein said baffle plate includes a return air opening defined therein and generally aligned with said blower fan, said return air opening for permitting air in said baking compartment to be drawn into said blower compartment for mixing with heated air drawn in from said inlet air passageway.

7. The convection oven according to claim 6, further comprising at least one peripheral opening connecting said blower compartment with said baking compartment outwardly from said return air opening, said peripheral opening for permitting air to flow from said blower compartment into said baking compartment.

8. The convection oven according to claim 7, includes four peripheral openings defined between respective edges of said baffle plate and an interior surface of said oven chamber.

9. The convection oven according to claim 1, wherein each of said first pair of diverter plates is disposed adjacent to one of the low pressure zones, and wherein each of said second pair of diverter plates is disposed adjacent to one of the high pressure zones.

10. The convection oven according to claim 9, wherein said first pair of diverter plates are disposed adjacent to a lower left corner and an upper right corner of said oven chamber, and wherein said second pair of diverter plates are disposed adjacent to a lower right corner of the oven chamber and an upper left corner of said oven chamber.

11. The convection oven according to claim 9, wherein said first pair of diverter plates is disposed along a first diametrical axis of said blower fan, wherein said second pair of diverter plates is disposed along a second diametrical axis of said blower fan, and wherein said first and second diametrical axes are generally perpendicular to one another.

12. The convection oven according to claim 9, wherein each of said first pair of diverter plates is disposed closer to a center rotational axis of said blower fan than said second pair of diverter plates.

13. The convection oven according to claim 9, wherein said diverter plates are generally planar.

14. The convection oven according to claim 9, wherein each one of said diverter plates includes a lateral flange attached to a side edge of said diverter plate.

15. The convection oven according to claim 14, wherein said lateral flanges extend from trailing edges of said first pair of diverter plates.

16. The convection oven according to claim 14, wherein said lateral flanges extend from leading edges of said second pair of diverter plates.

17. The convection oven according to claim 14, wherein said lateral flanges extend from said diverter plates at approximately a 45 degree angle.

18. The convection oven according to claim 15, wherein each one of said first pair of diverter plates also includes a horizontal flange attached to a top edge of said diverter and extending therefrom towards said blower fan, said horizontal flange generally parallel to said baffle plate.

19. The convection oven according to claim 9, wherein each one of said diverter plates includes a mounting flange for securing each said diverter plate to said wall of said oven chamber from which said baffle plate is spaced.

20. The convection oven according to claim 9, wherein said diverter plates are formed from a substantially solid material with no perforations therethrough.

21. A convection oven, comprising:

a) an insulated oven chamber including a front access door, a floor, a ceiling, two side walls, and a rear wall;

b) an inlet air passageway communicating at one end with ambient external air and at another end with said oven chamber;

c) a heating element for heating air in said combustion chamber;

d) an exhaust passageway communicating with said oven chamber for exhausting air therefrom;

e) a blower fan mounted against said rear wall for drawing heated air from said inlet air passageway into said oven chamber, circulating the heated air in said oven chamber, and expelling air through said exhaust passageway, two diagonally opposing rear corners of said oven chamber and low pressure zones in two other diagonally opposing rear corners of said oven chamber; and f) an air distribution system arranged so as to reduce air pressure in said high pressure zones and increase air pressure in said low pressure zones, thereby tending to equalize air pressure within said oven chamber and ensure uniform cooking of food therein, said air distribution system including:

i) a baffle plate spaced from said rear wall, said baffle plate dividing said oven chamber into a blower compartment containing said blower fan and a baking compartment in which food is cooked, ii) a first pair of diverter plates disposed in said blower compartment on diametrically opposite sides of said blower fan, wherein each of said first pair of diverter plates is disposed adjacent to one of said low pressure zones, and iii) a second pair of diverter plates disposed in said blower compartment on diametrically opposite sides of said blower fan, wherein each of said second pair of diverter plates is disposed adjacent to one of said high pressure zones.

22. The convection oven according to claim 21, wherein said inlet air passageway includes a combustion chamber, and wherein said heating element comprises a gas burner for heating air in said combustion chamber.

23. The convection oven according to claim 21, wherein said air distribution system also includes:

a) a return air opening defined in said baffle plate and generally aligned with said blower fan, said return air opening for permitting air in said baking compartment to be drawn into said blower compartment for mixing with heated air drawn in from said inlet air passageway, and b) at least one peripheral opening connecting said blower compartment with said baking compartment radially outwards of said return air opening, said peripheral opening for permitting air to flow from said blower compartment into said baking compartment.

24. The convection oven according to claim 21, wherein said first pair of diverter plates is disposed along a first diametrical axis, wherein said second pair of diverter plates is disposed along a second diametrical axis, and wherein said first and second diametrical axes are generally perpendicular to one another.

25. The convection oven according to claim 21, wherein each one of said diverter plates is disposed generally perpendicular to said rear wall of said oven chamber and includes a lateral flange attached to a side edge thereof, said lateral flange extending from said diverter plate generally tangential to the rotational axis of said blower fan.

26. The convection oven according to claim 25, wherein said diverter plates are secured to said rear wall of said oven chamber by mounting flanges.

27. The convection oven according to claim 25, wherein said diverter plates are secured to a rear surface of said baffle plate.

28. The convection oven according to claim 25, wherein each one of said first set of diverter plates also includes a horizontal flange attached to a top edge thereof, said horizontal flanges extending from said diverter plates towards said blower fan generally parallel to said rear wall of said oven chamber.

29. The convection oven according to claim 25, wherein said lateral flanges of said first pair of diverter plates extend from trailing edges of each of said first pair of diverter plates, and wherein said lateral flanges of said second pair of diverter plates extend from leading edges of each of said second pair of diverter plates.

30. The convection oven according to claim 25, wherein said first pair of diverter plates are disposed closer to the rotational axis of said blower fan than said second pair of diverter plates.

31. The convection oven according to claim 25, wherein said lateral flanges of said second pair of diverter plates are longer than said lateral flanges of said first diverter plates.

32. The convection oven according to claim 21, wherein said diverter plates are formed from a substantially solid material with no perforations therethrough.

* * * * *